United States Patent [19]

Leffers

[11] 4,391,266

[45] Jul. 5, 1983

[54] STOVE APPARATUS

[76] Inventor: Arthur J. Leffers, 13004 Tonkel Rd., Fort Wayne, Ind. 46825

[21] Appl. No.: 224,431

[22] Filed: Jan. 12, 1981

[51] Int. Cl.[3] ..... F24B 7/00

[52] U.S. Cl. ..... 126/123; 126/63; 126/126

[58] Field of Search ..... 126/121, 126, 63, 66, 126/123

[56] References Cited

U.S. PATENT DOCUMENTS

| | | | |
|---|---|---|---|
| 3,952,721 | 4/1976 | Patterson | 126/126 |
| 4,263,889 | 4/1981 | Martenson | 126/121 |
| 4,300,526 | 11/1981 | McKay et al. | 126/121 |

*Primary Examiner*—Ronald C. Capossela
*Attorney, Agent, or Firm*—George A. Gust

[57] ABSTRACT

Stove apparatus comprising in combination with a firebox a surrounding heat-exchange housing spaced therefrom to provide for air circulating passages. Both the firebox and the housing have top, lateral sides and rear ends spaced apart in substantial parallelism. A front closure is provided on the firebox having an access door. The spaced lateral sides of the firebox and housing define air inlet passages having at the front ends thereof air inlet ports. The spaced tops define an outlet passage in communication with the inlet passages and have at the front end an air outlet port. Means are connected to the inlet ports for supplying a flow of air into the inlet passages, through the outlet passage and finally out of the outlet ports. Such air is heated by means of a fire burning in the firebox. Such apparatus may be used as a free-standing stove or as an insert for an existing fireplace.

16 Claims, 11 Drawing Figures

STOVE APPARATUS

BACKGROUND OF THE INVENTION

1. Field of the Invention

The present invention relates to stove apparatus and more particularly to such apparatus adapted to burn coal, wood or the like.

2. Description of the Prior Art

Wood and coal burning stoves of various types and for various purposes are well known in the art. Wood and coal burning insert units for installation in existing fireplaces are also well known, these being in different forms and employing heat exchange features whereby room air to be heated may be circulated therethrough and exhausted into a room to maintain an elevated temperature. It is well known that conventional fireplaces are extremely inefficient in the respect that the bulk of the heat energy produced is dissipated out of the flue and chimney rather than into the room. To render the use of such fireplaces more efficient, various heat exchange inserts as above mentioned have been employed.

SUMMARY OF THE INVENTION

The present invention relates to a stove apparatus which may be used in conjunction with a conventional fireplace or alternatively as a free-standing stove as the user may prefer. Such apparatus includes in combination a firebox having a heat-exchange housing thereabout and spaced therefrom. The space between the firebox and the housing is arranged into air circulating passages whereby air from a room may be drawn thereinto, heated and then exhausted back into the room. Both the firebox and the housing are provided with spaced tops, lateral sides and rear ends which provide for such passages. The spaced lateral sides define air inlet passages having at the front ends air inlet ports. The spaced tops define an outlet passage in communication with the inlet passages and having at the front end air outlet ports. An air blower or fan is connected to the inlet ports for supplying a flow of air to the inlet passages. A flue section mounted in the tops of both the firebox and the housing provide for venting combustion products from the firebox.

One of the features pertains to the firebox projecting beyond the front portion of the housing and the top of the firebox being in the form of a plate having a flat horizontal portion which projects forwardly of the housing. This projecting plate portion is thereby exposed providing a heated stove top. An access door is provided in a front closure plate over the firebox and is further laterally extended to form with the stove top two air chambers for mounting the fans.

With the apparatus inserted into an existing fireplace, the front portion of the firebox projects therefrom thereby exposing the stove top. By operating the fans, air from the room is circulated through the passages between the housing and the firebox where it is heated and then is exhausted back into the room thereby capturing much of the heat energy developed within the firebox.

It is an object of this invention to provide a stove apparatus which may be used in a free-standing arrangement or alternatively may be installed into an existing fireplace.

It is another object of this invention to provide a stove apparatus which may be inserted into an existing fireplace whereby use of the fireplace may be rendered more efficient.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
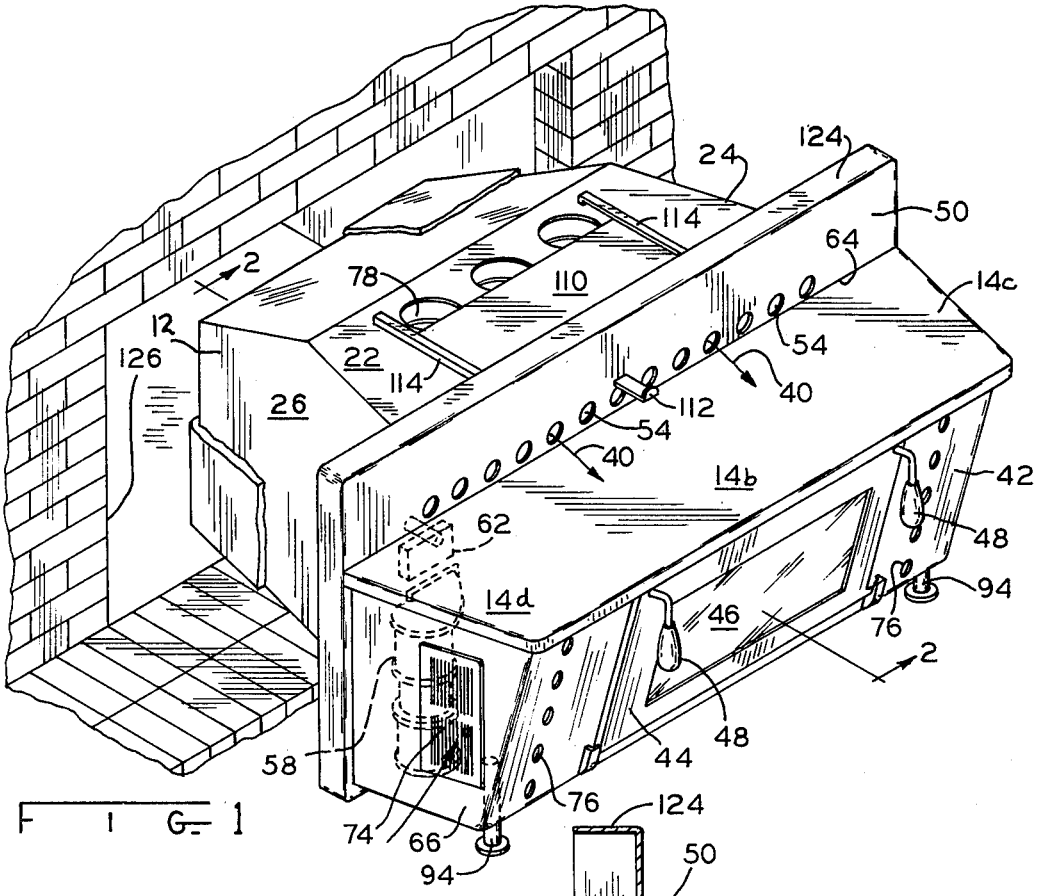
FIG. 1 is a perspective view of one embodiment of this invention positioned for insertion into an existing, conventional fireplace.

Referring to the drawings, a firebox indicated generally by the reference numeral 10 is surrounded in spaced relation by means of a heat-exchange housing 12, the space therebetween being utilized as air circulating passages by means of which air may be circulated from and back into a room after being heated. The firebox 10 includes a top plate 14, two lateral sides 16 and 18 and a rear plate 20. All of these are preferably in the form of suitably thick sheet metal formed to shape and welded so as to provide a box-like enclosure. The housing 12 is similarly provided with sheet metal parts in the form of a top 22, lateral sides 24 and 26, and a rear end 28. These are also welded together. The housing and firebox in one embodiment have a common bottom plate 30 welded thereto, the engaging portions thereof also being welded. In a second embodiment, the bottom plate 30 is omitted except for the portions which join the bottom edges of the lateral sides 16, 26 and 18, 24.

Figure 8:
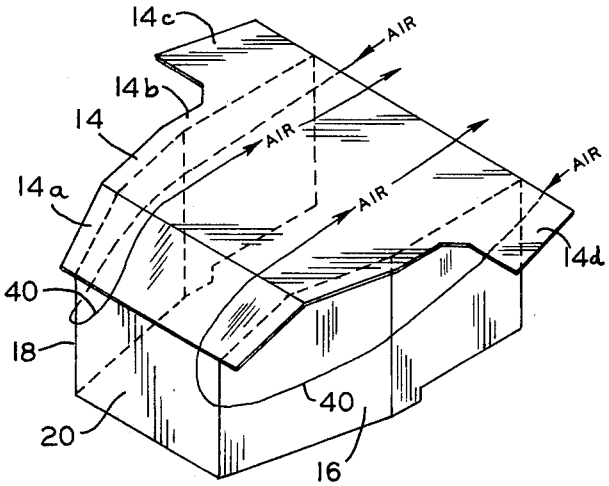
FIG. 8 is a rear perspective view of a portion of the firebox.

As shown more clearlyin FIG. 8, both top plates 14 and 22 have downwardly angled portions 14*a* and 22*a* and flat, horizontal portions 14*b* and 22*b*. As shown more clearly in FIG. 8, the plate section 14*b* has lateral extensions 14*c* and 14*d*.

Figure 2:
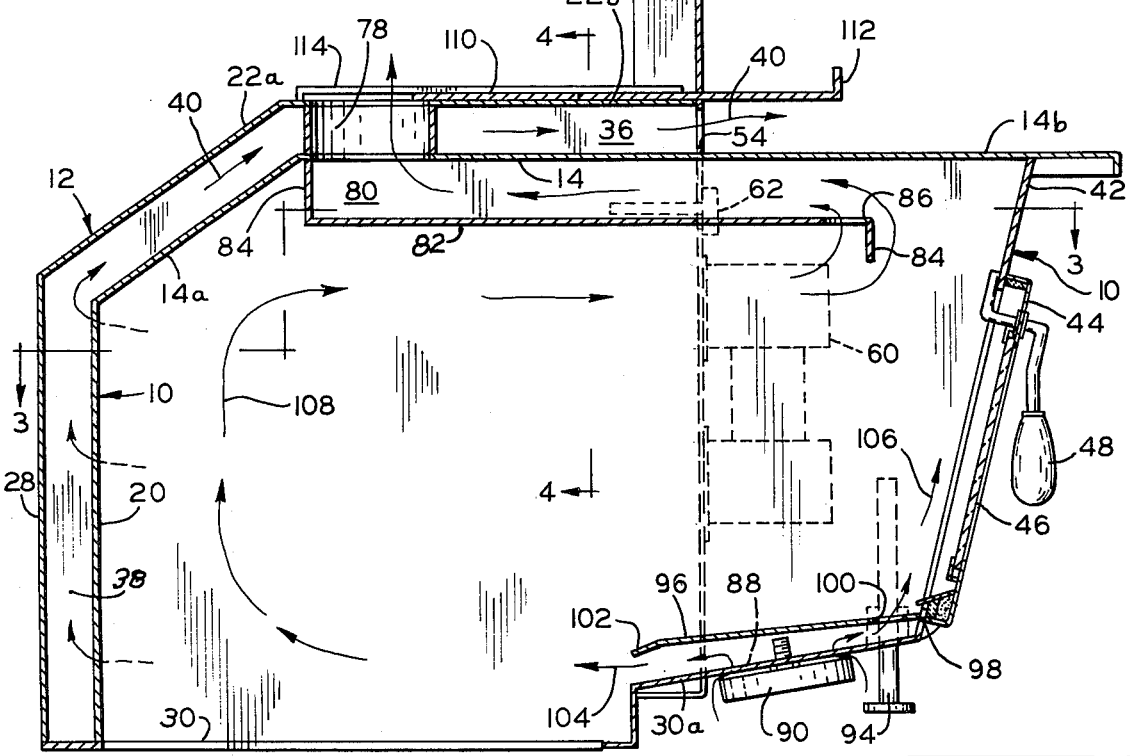
FIG. 2 is a cross section taken substantially along section line 2—2 of FIG. 1.
Figure 3:
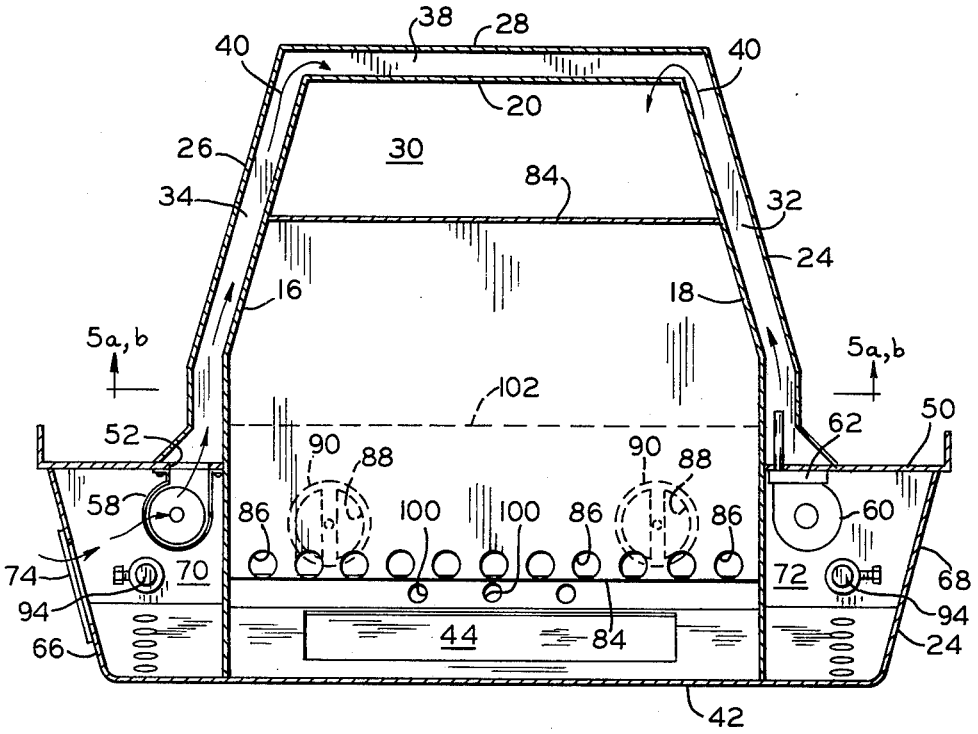
FIG. 3 is a sectional view taken substantially along section line 3—3 of FIG. 2.
Figure 6:
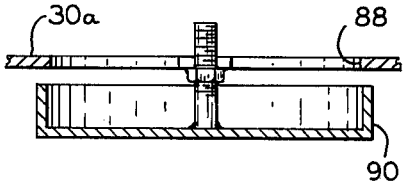
FIG. 6 is a fragmentary sectional view of the adjustable air intake otherwise shown in FIG. 2.
Figure 7:
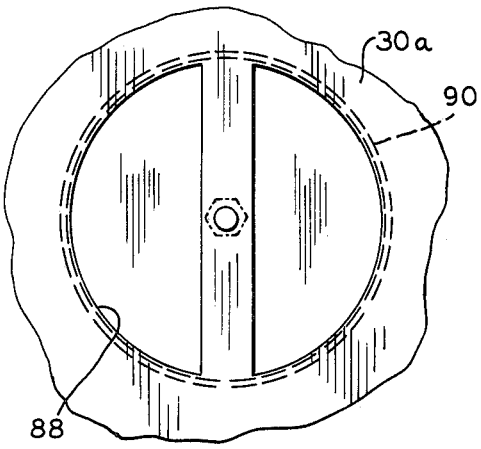
FIG. 7 is a plan view of the intake.

As shown in the three views of FIGS. 1, 2 and 3, the front portion of the firebox 10 projects beyond and out of the housing 12. The spaces between the sides 18, 24 and 16, 26 of the firebox and housing constitute air inlet passages 32 and 34 while a space between the top plates 14 and 22 provide an air outlet passage 36. The space between the rear ends 20 and 28 of the firebox and housing serves as a connecting passage between the inlet passages 32 and 34 an the outlet passage 36, this space being indicated by the numeral 38. As will be noted in FIG. 8, the top plate 14 of the firebox laterally projects beyond the sides 16 and 18. This projection determines the spacing between the side walls 18 and 24 on the one hand and 16 and 26 on the other, the edges of this plate 14 being welded to the housing sides 24 and 26. This serves in further defining the top of the inlet passages 32 and 34 such that air injected into the front ends of the passages 32 and 34 will be directed along the paths indicated by the arrows 40 into the rear space 38 and thereafter through and out of the discharge passage 36.

The front of the firebox 10 is closed by means of a plate 42 angled upwardly as shown. An access door is hingedly mounted in the front plate 42 for the purpose of loading and cleaning the firebox 10. The access door 44 is preferably provided with a window 46 and one or more manipulable latching handles 48.

Figure 9:
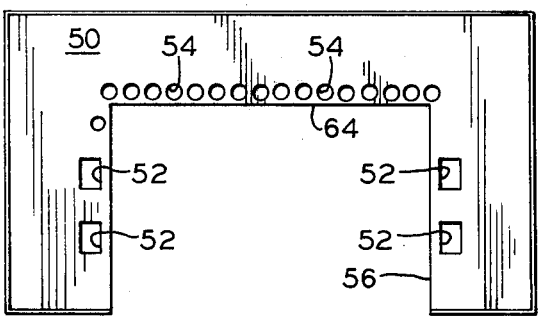
FIG. 9 is a front view of the face plate otherwise shown in FIGS. 1 and 2.

A face plate 50 shown in detail in FIG. 9 is engaged with the front edges of the housing sides 24 and 26 thereby serving as covers or closures of the front ends of the passages 32 and 34. Inlet ports 52 in the face plate 50 communicate with the two passages 32 and 34. A line of circular holes 54 also in the face plate 50 are in communication with the front end of the discharge passage 36 and serve as outlet ports. The inner edges 56 of the face plate abut against the firebox sides 16 and 18 and are welded thereto. Mounted on the face plate in registry with the inlet ports 52 are two electric fans or blowers 58 and 60 which force air in the direction of the arrows 40 into and through the passages 32 and 34. These blowers may be of a form as manufactured by Dayton Electric Manufacturing Company, 5959 West Howard Street, Chicago, Ill., Model No. 4C015A, 115 volts 60 hz. A thermostatic control 62 is also mounted on the face plate 50 to sense the temperature of the air within one of the passages 32, 34. This control 62 is wired to the electric motors of the two blowers 58 and 60 and serves in energizing the motors upon the temperature in the passages 32 and 34 rising to a predetermined level.

The forwardly projecting portion **14*b* of the top plate of the firebox is substantially coextensive in width to that of the face plate 50 as shown in FIG. 1. The straight edge 64 of the face plate 50 engages the upper surface of plate portion 14*b*** and preferably is welded thereto.

The front plate 42 which closes the front end of the firebox 10 is also bent rearwardly in the form of side panels 66 and 68 which are engaged with and welded to the face plate 50 near the outer edges thereof. This forms two air-intake chambers 70 and 72 as shown which contain the two electric blowers 58 and 60, respectively. Suitable registers 74 are provided in the side panels 66 and 68 as shown through which room air is drawn by the blowers 58 and 60. Auxiliary intake ports 76 may be provided in the front plate 42 as shown.

One or more sections of pipe indicated by the numeral 78 are inserted between the two top plates 14 and 22 as shown and communicate with openings therein for receiving therethrough smoke and gases from the firebox itself. A flue chamber 80 is formed immediately beneath these pipe sections 78 by means of a flat plate 82 spaced from and parallel with the top plate 14 and welded at the edges thereof to the side plates 16 and 18 of the firebox. An end plate 84 closes the rear end of the chamber 80 and connects the plate 82 to the top plate 14. The front end of the plate 82 extends forwardly short of the front plate 42 but beyond the face plate 50 as shown. The front end of this plate 82 is bent downwardly to form a flange 84, and a series of holes 86 are also provided in this plate adjacent flange 84, which extend in a straight line parallel to the flange 84.

The bottom of the firebox 10 has an upwardly stepped portion **30*a* in which are provided two draft ports 88. An air intake or draft valve of circular shape is threadedly mounted on the bottom section 30*a* and upon being rotated varies the size of the opening of the port 88 into the firebox 10. Suitable legs 94 may be threadedly mounted in the bottom section 30*a*** for supporting the front end of the firebox from a suitable mounting surface.

An air-deflecting plate 96 (FIG. 2) is mounted within the firebox 10 in parallel, spaced relation with respect to the bottom section **30*a*, the front edge 98 of this plate 96 being welded to the front plate 42. Suitable openings 100 are provided in the plate 96 adjacent to the front plate 42 for the purpose of receiving a current of air upwardly past the window 46 in the door 44. This serves to keep deposits, such as creosote, from settling onto the window 46**.

The rear end 102 of plate 96 is bent downwardly at a slight angle as shown. Air entering the port 88 is deflected by the plate 96 both rearwardly and forwardly as indicated by the arrows 104 and 106 into the firebox. Since the fire is normally built in the central portion of the firebox 10 and is supported by the bottom portion 30, the flow 104 supports the combustion. Smoke and the gaeous products of combustion thus tend to be directed as indicated by the other arrows 108 along the underside of the flue plate 82 and upwardly into the chamber 80 via the holes 86 and around the flange 84. The flange 84 tends to deflect this flow upwardly through the holes 86 thereby tending to keep the window 46 free of contaminants. The air currents 106 upwardly past the window 46 serve the same purpose.

The gases which enter the flue chamber 80 pass outwardly through the pipe sections 78.

A damper plate 110 is mounted for reciprocation on the top surface of the housing plate 22 (see FIG. 1) and has a handle 112 projecting through the face plate 50 by means of which it can be adjusted. The opposite edges of the plate 110 are slidably received in suitable channels 114 secured to the top 22 as shown. By moving the handle 112 inwardly or outwardly, the openings of the pipe section 78 may be controlled in size thereby serving as a control of the draft to the firebox.

Figure 5A:
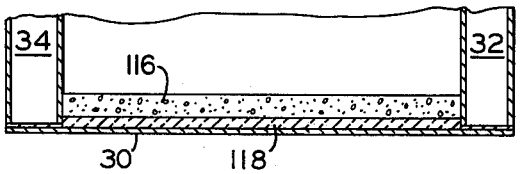
FIG. 5*a* is a fragmentary sectional view taken substantially along section line 5*a*—5*a* of FIG. 3 of a particular embodiment.
Figure 5B:
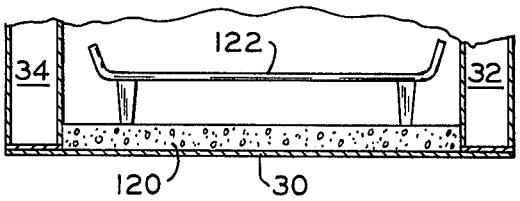
FIG. 5*b* is a similar view taken substantially along section line 5*b*—5*b* of FIG. 3 of another embodiment.
Figure 4:
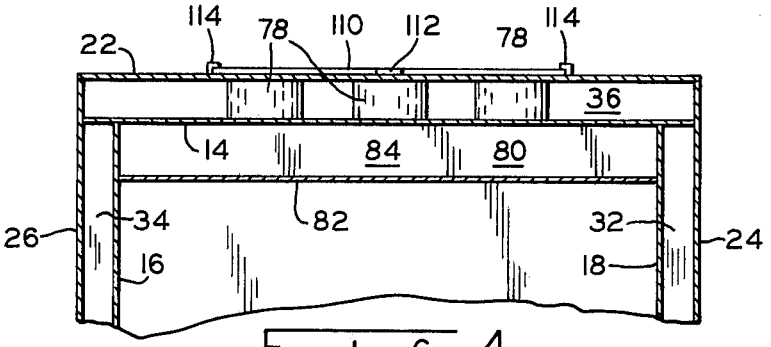
FIG. 4 is a fragmentary sectional view taken substantially along section 4—4 of FIG. 2.

For protecting the bottom plate 30, as shown in FIG. **5*a*, a concrete base 116 may be used which is held off the plate 30 by a layer 118 of suitable fireproof insulation. In FIG. 5*b* is shown a slightly different arrangement wherein a slab of concrete 120 is disposed on the bottom plate 30 to carry a conventional grate 122**.

As shown more clearly in FIGS. 1, 2 and 3, the sides and top of the housing-firebox combination are slightly tapered, and the face plate 50 has rearwardly extending flanges 124 around the periphery thereof. The unit may thus be inserted into a conventional fireplace 126 until the flange 124 seals against the bricks lining the opening. That portion of the apparatus extending to the rear of the face plate 50, of course, fits within the fireplace. The legs 94 can be supported on the hearth. So installed, a fire may be built on the bottom 30 using either wood or coal as the combustible material. Combustion air enters the ports 88 and flows to the fire, with the gaseous products of combustion, which include smoke, passes upwardly as depicted by the arrow 108 out of the pipe sections 78. When the temperature of the air in the passages 32 and 34 rises to a predetermined level, the thermostatic control 62 turns on the blowers 58 and 60. Air is drawn into the intake chambers 70 and 72 through the registers 74 and therefrom through the inlet ports 52 into the passages 32 and 34. This circulation continues into the rear chamber 38 from which it passes upwardly and over the top of the firebox through the discharge passage 38 from which it is exhausted into the room by means of the outlet ports 54.

Except for the air inlet passages 32 and 34, the bottom 30 for the firebox 10 may be omitted in which event the floor of the fireplace serves as the bottom with the fireplace unit 10, 12 resting thereon.

Figure 10:
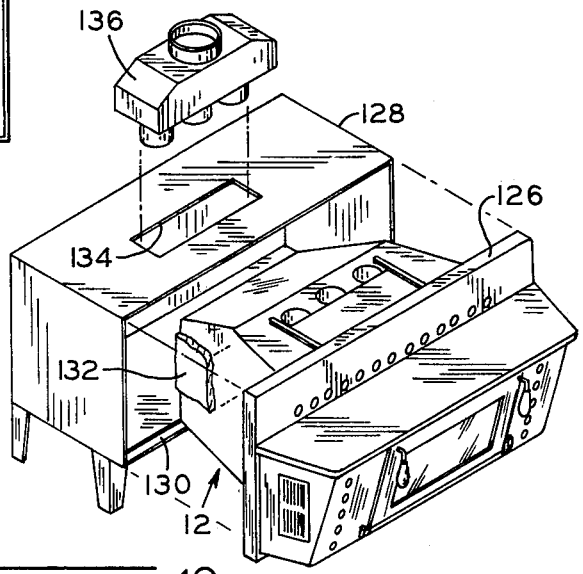
FIG. 10 is an exploded, perspective view of a free-standing stove employing the apparatus of this invention.

Instead of installing the stove apparatus in a fireplace, a metal cabinet 128 (FIG. 10) may be used into which the stove apparatus may be inserted. The cabinet 128 is made to such size that the flange 126 will snugly fit thereover to provide a suitable seal. A layer 130 of insulation may be provided in the bottom of the cabinet 128, and the housing 12 may otherwise be lined with suitable insulation 132 to inhibit the escape of heat. A flow opening 134 may be provided in the top of the cabinet 128 to receive a flue fitting 136 which fits into the pipe sections 78 in the stove apparatus.

While there have been described above the principles of this invention in connection with specific apparatus, it is to be clearly understood that this description is made only by way of example and not as a limitation to the scope of the invention.

What is claimed is:

1. Stove apparatus comprising a firebox, a heat-exchange housing enclosing said firebox and spaced therefrom to provide air circulating passages, said firebox having a top, lateral sides and a rear end, said housing also having a bottom, top, lateral sides and a rear end respectively spaced in substantial parallelism from the corresponding parts of said firebox, a front closure on said firebox having an access door, said spaced lateral sides of said firebox and housing defining air inlet passages having at the front ends thereof air inlet ports, said spaced tops defining an air outlet passage in communication with said inlet passages and having at the front end thereof an air outlet port, means connected to said inlet ports for supplying a flow of air to said inlet passages, means for admitting combustion air to said firebox, and means for venting smoke from said firebox in by-passing relation to said housing and said top air outlet passage, said firebox projecting beyond the front portion of said housing, said top of said firebox being in the form of a plate having a flat horizontal portion which projects forwardly of said housing and is exposed thereby providing a stove top, said top plate of said firebox engaging at the lateral edges thereof said housing sides thereby further defining said inlet passages, the space between said housing and firebox rear ends serving to connect said inlet passages to said outlet passage.

2. The apparatus of claim 1 wherein a face plate straddles said firebox in covering relation to said inlet and outlet ports and separates said housing from the projecting portion of said firebox, said face plate having inlet openings in registry with said inlet ports and outlet openings in registry with said outlet port, said means for supplying air including electric blowers.

3. The apparatus of claim 2 wherein said face plate extends laterally beyond and above said housing thereby to close the opening of a fireplace into which such stove apparatus may be inserted, the front portion of said firebox thus being positioned forwardly of said face plate outside of said fireplace.

4. The apparatus of claim 2 wherein the portion of said top plate that projects forwardly of said housing also extends laterally therebeyond thereby to provide an extended area stove top.

5. The apparatus of claim 4 wherein said face plate also extends laterally beyond said housing substantially coextensively with the forwardly projecting portion of said stove top, said front closure on said firebox also extending laterally therebeyond substantially coextensively with said face plate and stove top and having sides connected with the lateral extremities of said face plate and stove top thereby to form two air intake chambers, said blowers being mounted in said chambers, and said chambers having air intake openings for supplying room air to said blowers.

6. The apparatus of claim 5 wherein said front closure is substantially planar and is angled outwardly from the bottom to top thereof, said access door being substantially coplanar with said front closure.

7. The apparatus of claim 6 wherein said firebox and housing conjointly are angled outwardly from the rear toward the front, said face plate having a rearwardly extending flange adapted to engage and seal the opening of a fireplace into which the stove apparatus is inserted.

8. The apparatus of claim 1 wherein said firebox includes a flue chamber beneath and extending substantially parallel to a portion of the top plate, said flue chamber being closed at the sides and rear and communicating with said venting means, the front of said flue chamber being open and disposed forwardly of said housing but spaced from said front closure near the upper portion of said access door thereby providing a path for smoke and gases developed within said firebox that extends from the rear toward the front and then back through the flue chamber and out of said venting means.

9. The apparatus of claim 8 wherein flue chamber is defined by a flue plate spaced from but substantially parallel to said firebox top, said flue plate at its lateral edges engaging the lateral sides of said firebox.

10. The apparatus of claim 9 wherein said venting means includes at least one pipe section traversing the space between the tops of said housing and firebox and which opens into said flue chamber near the rear thereof and through the top of said housing.

11. The apparatus of claim 10 wherein said flue plate at the forward end has a depending flange and a series of openings adjacent the flange through which a portion of the smoke and gases may pass from said firebox into said flue chamber.

12. The apparatus of claim 10 wherein said front closure is planar and is angled outwardly from the bottom toward the top, said access door being substantially coplanar with said closure, the bottom of said firebox near said front closure having at least one draft opening.

13. The apparatus of claim 1 in which an air deflecting plate is joined to the front closure and extends rearwardly in parallel spaced relation with the firebox bottom, said means for admitting combustion air being a draft opening in a bottom plate of said firebox opposite said deflecting plate, and said deflecting plate having one or more holes therein adjacent to said access door whereby air entering said draft opening not only passes rearwardly into said firebox but also through said holes and upwardly adjacent to said access door.

14. The apparatus of claim 13 wherein said face plate straddles said firebox in covering relation to said inlet and outlet ports and separates said housing from the projecting portion of said firebox, said face plate having inlet openings in registry with said inlet ports and outlet openings in registry with said outlet port, said means for suppling air including electric blowers, said face plate extending laterally beyond and above said housing thereby to close the opening of a fireplace into which such stove apparatus may be inserted, the front portion of said firebox thus being positioned forwardly of said face plate and outwardly of said fireplace, the portion of said top plate that projects forwardly of said housing also extending laterally therebeyond thereby to provide an extended area stove top, said face plate also extending laterally beyond said housing substantially coextensively with the forwardly projecting portion of said stove top, said front closure on said firebox also extending laterally therebeyond substantially coextensively with said face plate and stove top and having sides connected with the lateral extremities of said face place and stove top thereby to form two air intake chambers, said blowers being mounted in said chambers, and said chambers having air intake openings for supplying room air to said blowers.

15. The apparatus of claim 14 including a flat damper plate reciprocably mounted on said top of said housing to control the opening of said flue pipe therethrough.

16. The apparatus of claim 15 including a cabinet supported on legs, said cabinet having an open front and receiving said stove apparatus therein, said face plate fitting over the front edge of said opening, and said cabinet having a flue opening which communicates with said flue pipe.

* * * * *